US006082131A

United States Patent [19]

Hirosawa et al.

[11] Patent Number: 6,082,131

[45] Date of Patent: Jul. 4, 2000

[54] REFRIGERATOR

[75] Inventors: Masaru Hirosawa; Hiroyuki Ichouda; Yasuhide Koike; Tomio Suyama, all of Shimane, Japan

[73] Assignee: Hoshizaki Denki Co., Ltd., Toyoake, Japan

[21] Appl. No.: 09/175,568

[22] Filed: Oct. 20, 1998

[51] Int. Cl.[7] ..... F25D 19/02

[52] U.S. Cl. ..... 62/448; 62/258; 62/298; 62/297; 62/302; 62/450

[58] Field of Search ..... 62/258, 298, 297, 62/302, 448, 450

[56] References Cited

U.S. PATENT DOCUMENTS

| | | | |
|---|---|---|---|
| 4,876,860 | 10/1989 | Negishi | 62/179 |
| 4,972,682 | 11/1990 | Smith et al. | 62/405 |
| 5,065,592 | 11/1991 | Takano et al. | 62/180 |
| 5,355,686 | 10/1994 | Weiss | 62/89 |
| 5,471,849 | 12/1995 | Bessler | 62/186 |
| 5,491,980 | 2/1996 | Yingst et al. | 62/237 |
| 5,657,639 | 8/1997 | Lidbeck | 62/186 |
| 5,729,994 | 3/1998 | Mukaiyama et al. | 62/186 |

FOREIGN PATENT DOCUMENTS

| | | |
|---|---|---|
| 6-213553 | 8/1994 | Japan . |
| 2-260341 | 10/1995 | Japan . |
| 7-260319 | 10/1995 | Japan . |

*Primary Examiner*—Henry Bennett
*Assistant Examiner*—Mark Shulman
*Attorney, Agent, or Firm*—Wenderoth, Lind & Ponack, L.L.P.

[57] ABSTRACT

A refrigerator includes a support panel extending sideways from a bottom of a storage heat insulating box at one side of the box. An evaporator heat insulating box is provided for accommodating an evaporator and is formed at the one side of the storage heat insulating box with an equipment accommodating space being formed between itself and the base panel. A back panel extends from the rear wall of the storage heat insulating box so as to form rear walls of the evaporator heat insulating box and the equipment accommodating space, respectively. A side panel is continuous to the back panel so as to define an air circulation space together with a side of the evaporator heat insulating box. A front panel is continuous to the side panel so as to provide a front of the evaporator heat insulating box and the equipment accommodating space. The front panel has in its lower portion a suction hole communicating with the equipment accommodating space and in its upper portion an exhaust hole communicating with the air circulation space. Also, a fan is provided in the equipment accommodating space, and can be driven to draw air in through the suction hole to cool the condenser and the compressor. The drawn air is discharged as hot air through the air circulation space at one side of the evaporator compartment and the exhaust hole.

5 Claims, 5 Drawing Sheets

REFRIGERATOR

BACKGROUND OF THE INVENTION

1. Field of the Invention

This invention relates to a refrigerator, and more particularly to an improvement in the structure for discharging hot air after cooling air has cooled a condenser unit.

2. Description of the Prior Art

There have been provided refrigerators of the table type in which a cold storage compartment has a reduced height. Japanese Laid-open Patent Publication No. 7-260319 (1995) filed by the assignee of the present application discloses one of such refrigerators. The disclosed refrigerator comprises an evaporator compartment defined by heat insulating walls at one side of a cold storage compartment and accommodating an evaporator. An equipment compartment accommodating a compressor, a condenser, etc. is provided under the evaporator compartment. The compressor and the condenser accommodated in the equipment compartment generate heat. In view of this, a fan is provided in the equipment compartment so that hot air resulting from heat exchange of air passing through the compressor and the condenser is discharged outside through exhaust holes formed in a side panel and a rear panel of the equipment compartment.

However, when the refrigerators of the type described above are installed, the rear wall and the side walls thereof are often vabutted against walls of a kitchen or other kitchen equipment. This manner of installation closes the exhaust holes of the refrigerators, thereby preventing smooth discharge of the hot air. Consequently, a cooling performance of the refrigerator is reduced.

SUMMARY OF THE INVENTION

Therefore, an object of the present invention is to provide a refrigerator in which the hot air can smoothly be discharged so that a reduction in the cooling performance is prevented.

The present invention provides a refrigerator comprising a support panel extending sidewise from a bottom of a storage heat insulating box for storing articles at one side of the box. An evaporator heat insulating box is provided for accommodating an evaporator. A pair of support frames are provided toward the front and toward the rear of the evaporator heat insulating box between the box and the support panel to support the box. The support frames are mounted on mounting members provided on the side of the evaporator heat insulating box so as to protrude sideways therefrom. A side panel is provided to define an air circulation space together with a side of the evaporator heat insulating box. A front panel has a suction hole in a lower portion thereof and an exhaust hole in an upper portion thereof. The exhaust hole communicates with the air circulation space. A fan provided in a equipment accommodating space beneath the evaporator heat insulating box is driven so that outside air is drawn in through the suction hole to cool an atmosphere in the equipment accommodating space. The drawn air is thereafter exhausted as hot air through the air circulation space and the exhaust hole in turn.

According to the above-described construction, the hot air is discharged outside reliably and smoothly even when the exhaust holes of the rear and the side of the equipment compartment are closed. Consequently, the cooling performance of the refrigerator can be prevented from being reduced.

In a preferred form, the back panel and the side panel have exhaust holes through which the hot air is discharged, respectively. The hot air can smoothly be discharged when these exhaust holes of the back and side panels are not closed.

In another preferred form, a base plate is provided under the support panel for supporting the support panel. The support panel is forwardly drawable so as to be slid on the base plate. A heat insulating cover is provided on the support panel so as to be located over the condenser and the compressor. The heat insulating cover covers the evaporator accommodated in the evaporator heat insulating box and a front opening of the evaporator heat insulating box. Consequently, a maintenance efficiency can be improved since the overall refrigeration unit is drawable.

In further another preferred form, the evaporator heat insulating box includes a plurality of stud bolts standing on upper and lower portions of the front thereof. The heat insulating cover has a plurality of bolt insertion holes through which the stud bolts are thrust respectively. When the refrigeration unit is thrust into the evaporator heat insulating box, nuts are engaged with distal ends of the respective stud bolts and tightened up, so that the heat insulating cover is closely pressed against the front of the evaporator heat insulating box. Consequently, the heat insulating efficiency can be improved.

BREIF DESCRIPTION OF THE DRAWINGS

Other objects, features and advantages of the present invention will become clear upon reviewing the following description of the preferred embodiment, made with reference to the accompanying drawings, in which.

DETAILED DESCRIPTION OF THE PREFERRED EMBODIMENT

Figure 2:
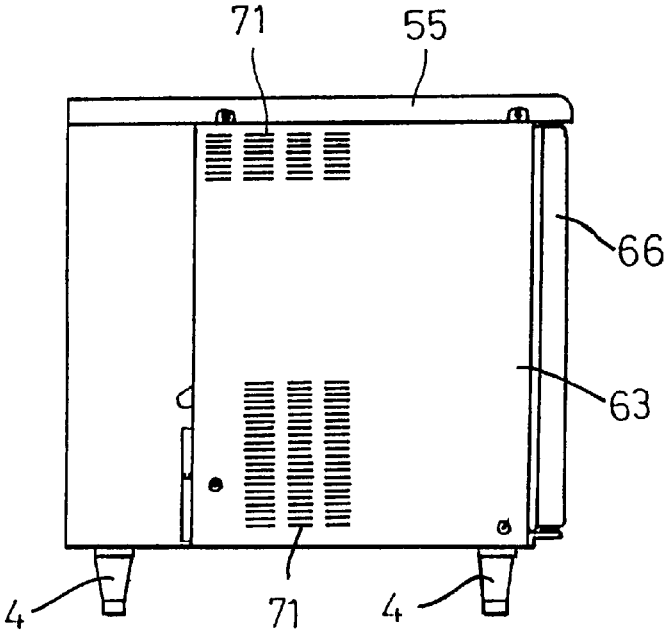
FIG. 2 is a side view of the refrigerator shown in FIG. 1.
Figure 3:
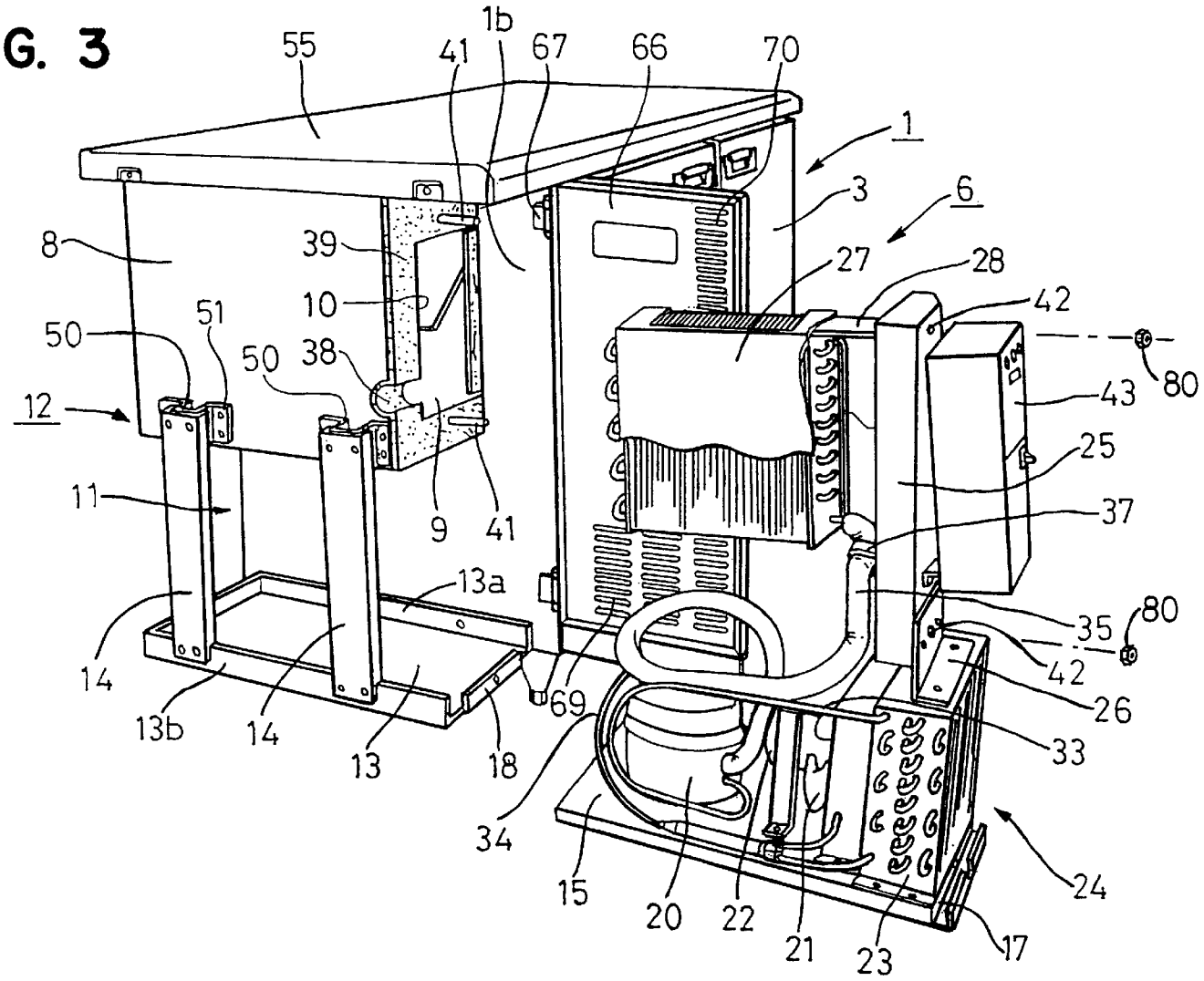
FIG. 3 is a perspective view of the refrigerator, showing the condition before accommodation of a cooling unit.
Figure 4:
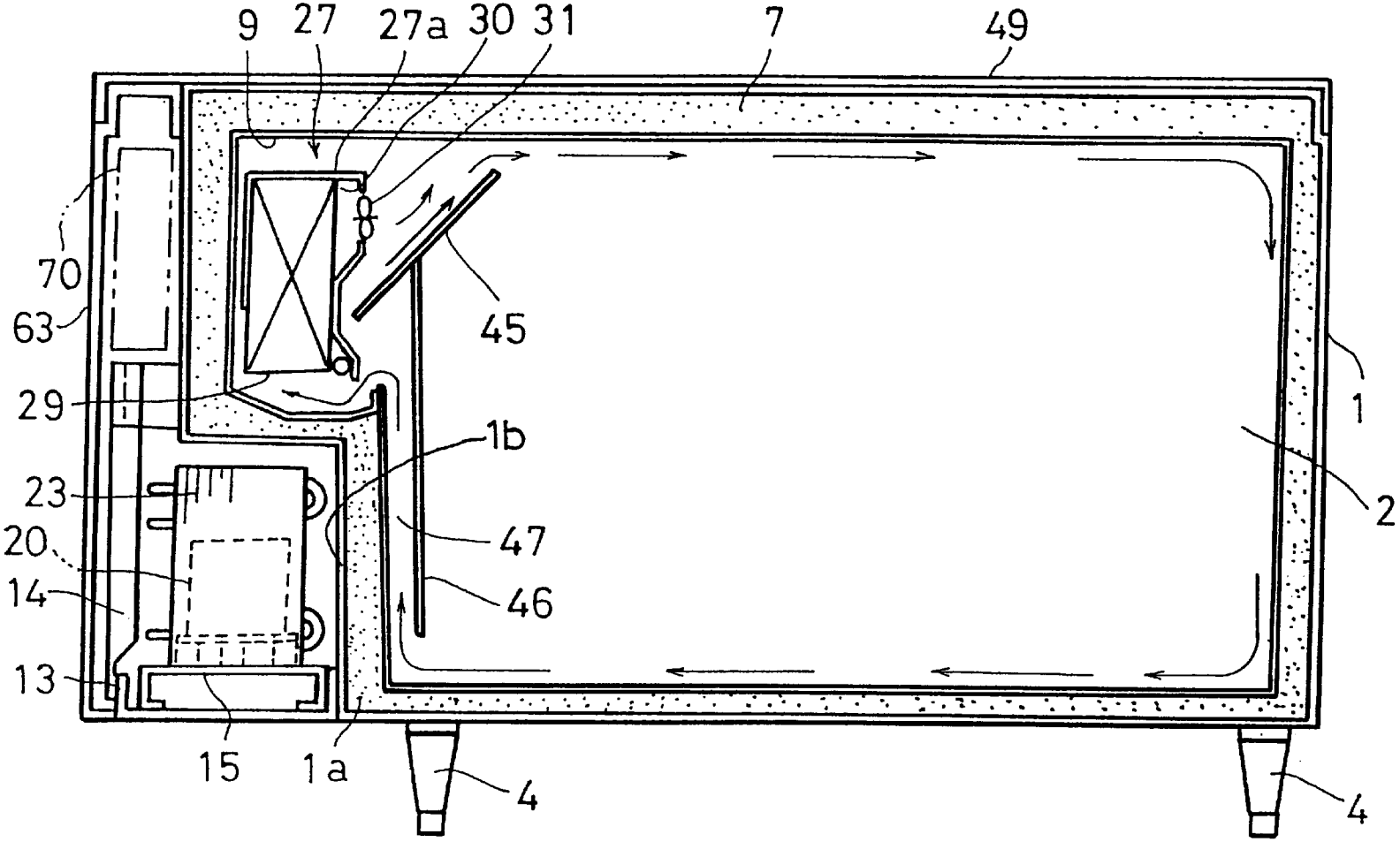
FIG. 4 is a longitudinal section of the refrigerator, showing the inner structure of the refrigerator.

One embodiment of the present invention will be described with reference to FIGS. 1 to 6. Referring to FIGS. 1 to 4, a storage compartment heating insulating box 1 constituting the body of a refrigerator in accordance with the invention is shown. The storage compartment heat insulating box 1 has a front opening and is elongated in a sideways direction. A cold storage compartment 2 for storing food etc. is defined in an interior of the storage compartment heat insulating box 1 as shown in FIG. 4. A double-leafed door 3 is hingedly mounted on the front of the box 1 so as to close and open the front opening thereof. Legs 4 are mounted on four corners of the bottom of the box 1, respectively, to support the box.

A refrigeration unit 6 is drawably or removably accommodated in an equipment compartment defined at a left-hand side of the heat insulating box 1. More specifically, an upper left-hand side 1*b* of the heat insulating box 1 projects forwardly of a rectangular paralellepiped evaporator heat insulating box 8, which is formed integrally with the storage heating insulating box 1. The box 8 is formed so as to be set back from both the front and the rear of the box 1 by predetermined dimensions, respectively. An evaporator compartment 9 is defined in an interior of the heat insulating box 8. Walls defining the heat insulating boxes 1 and 8 are filled with a heat insulating material 7 so that the interiors of the boxes 1 and 8 are insulated from heat. A front wall of the evaporator heat insulating box 8 is formed with a front opening 10. An equipment accommodating space 11 is defined beneath the box 8. The space 11 and the box 8 constitute an equipment compartment 12. The refrigeration unit 6 comprising a condenser 23, a compressor 20, and an evaporator 27 is drawably accommodated in the equipment compartment 12.

Figure 5:
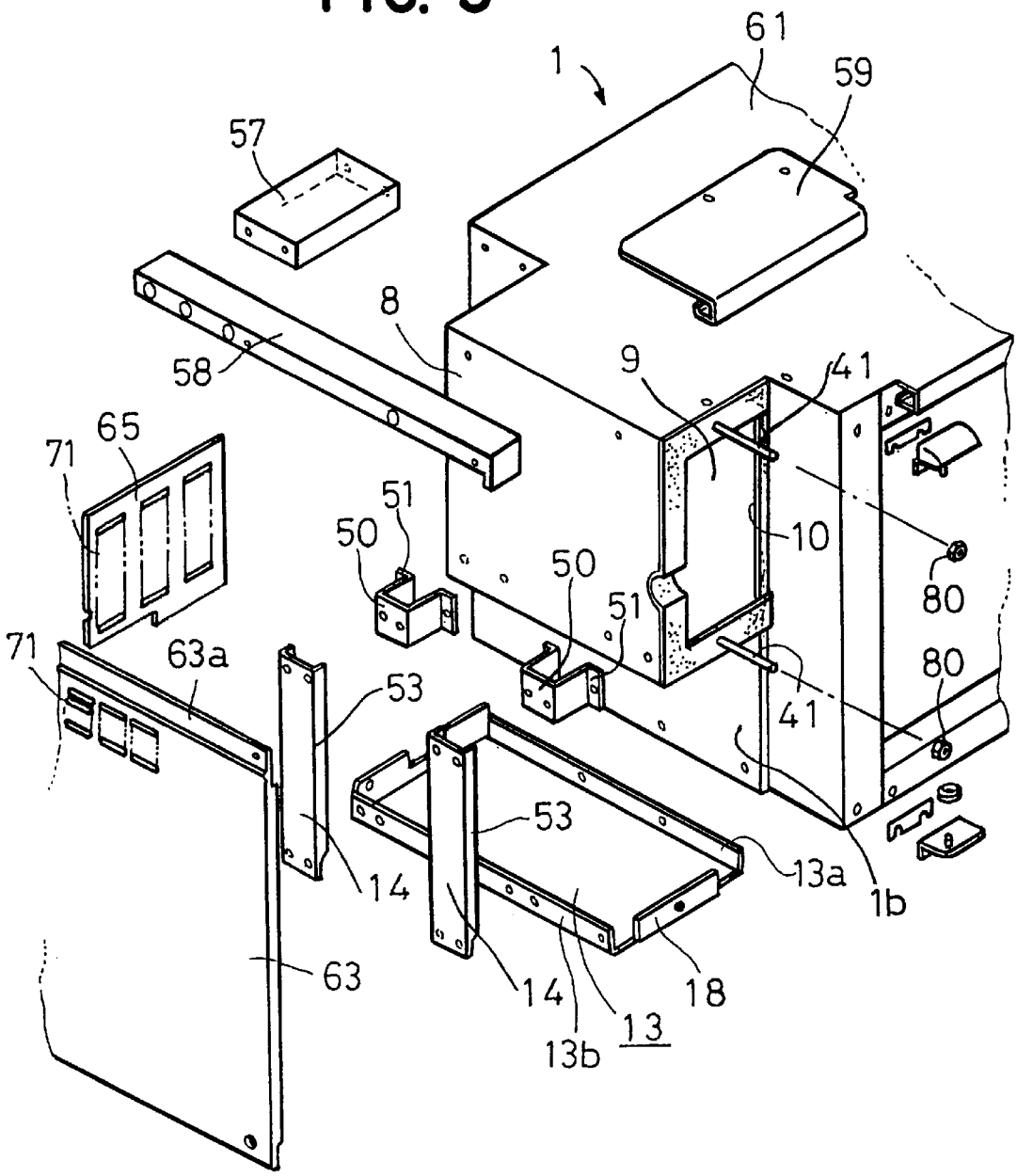
FIG. 5 is an exploded perspective view of an equipment compartment of the refrigerator.
Figure 6:
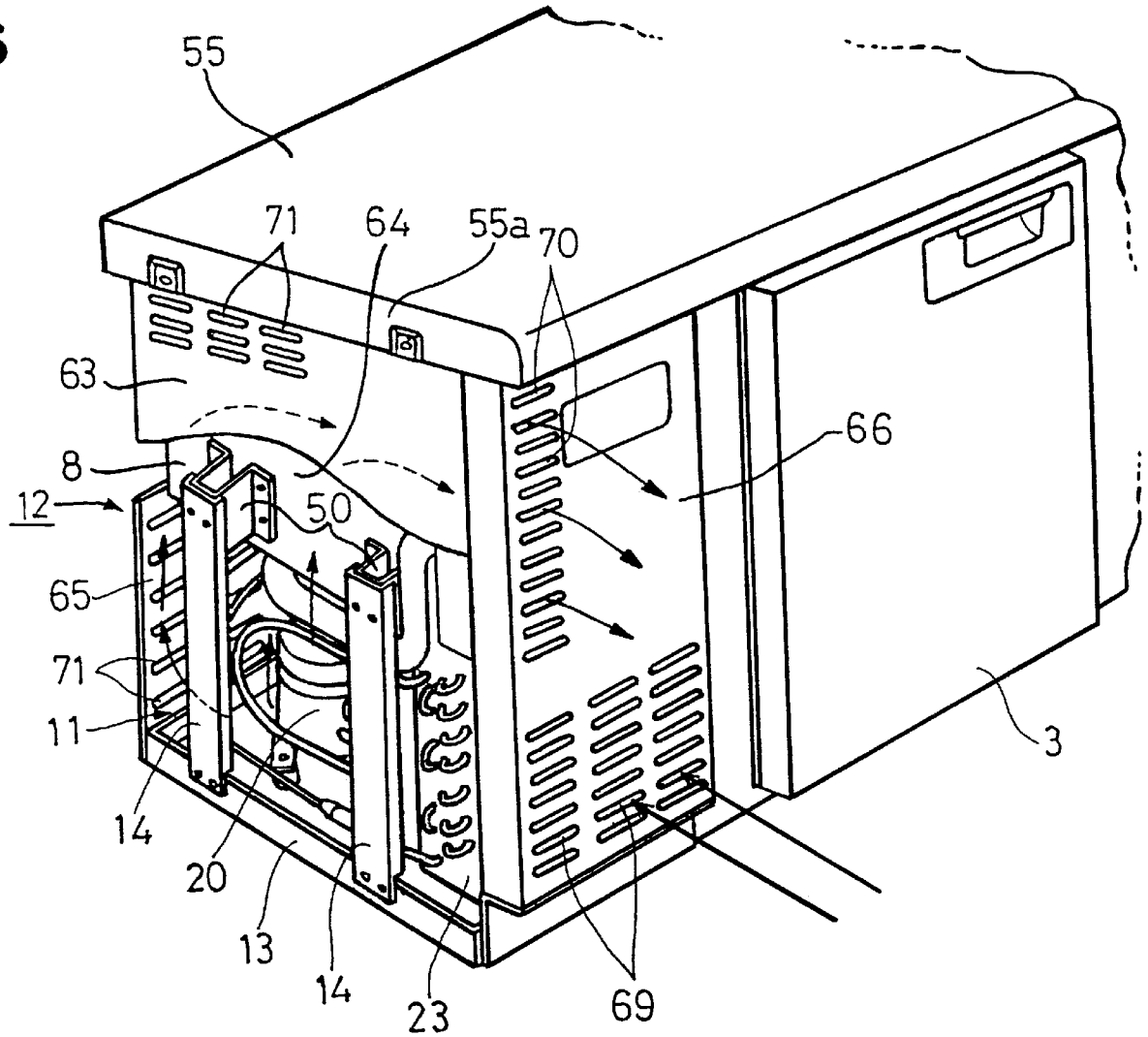
FIG. 6 is a partially cut away perspective view of the refrigerator, showing a flow of hot air.

A shallow dish-shaped base plate 13 is provided below the box 8 to define a bottom of the equipment accommodating space 11. More specifically, one side edge 13*a* of the base plate 13 is fixed to the lower edge of the left-hand side of the heat insulating box 1. A pair of support frames 14 are mounted on brackets 50 further mounted on front and rear ends of a lower side edge of the box 8, respectively. The support frames 14 extend downward from the heat insulating box 8. Each bracket 50 has a generally C-shaped section as shown in FIG. 5 and includes mounting flanges 51 bent outward approximately at right angles to both side plates respectively. Each bracket 50 is fixed to the side of the evaporator heat insulating box 8 by fastening the flange 51 with rivets.

Each support frame 14 is vertically elongated and has flanges 53 formed by bending both side edges at right angles, respectively. A lower end of each flange 53 is cut out by predetermined dimensions. An upper end of each support frame 14 is fitted with the protruding portion of the corresponding bracket 50 and riveted as shown in FIG. 3. The other side edge 13*b* of the base plate 13 is abutted against and then screwed to the cut-out lower inner ends of the flanges 53 of the support frames 14, so that the base plate 13 is supported. In other words, the support frames 14 supporting the side edge 13*b* of the base plate 13 in a suspending manner protrudes leftward (frontward as viewed in FIG. 3) relative to the evaporator heat insulating box 8 when having been mounted in position.

A support panel 15 of the refrigeration unit 6 is slid forward and backward so as to be placed on the base plate 13. Left-hand and right-hand side edges of the support panel 15 are bent downward. The support panel 15 can be pushed so as to slide on the base plate 13 from the front. The pushing is stopped when an abutment plate 17, provided on the front edge (the right-hand side as viewed in FIG. 3) of the support panel 15, abuts a screw receiving strip 18 rising from the central front edge of the base plate 13. Both the abutment plate 17 and the screw receiving strip 18 are screwed so that the support panel 15 is fixed.

The refrigeration unit 6 is divided into components or equipment to be accommodated in the equipment accommodating space 11 and components or equipment to be accommodated in the evaporator compartment 9. These components are stacked on the support panel 15. The components to be accommodated in the equipment accommodating space 11 include an innermost compressor 20, a fan 21 driven by an electric motor 22 and disposed in front of the compressor 20, and a condenser 23 disposed in the forefront. A heat insulating cover 25 is fixed to an L-shaped bracket 26 further fixed to the top of the condenser 23 so as to be located over the condenser 23. The heat insulating cover 25 is provided for closing the front opening 10 of the evaporator compartment 9. An evaporator 27 is fixed to a bracket 28 that is fixed to the backside of the heating insulating cover 25. The evaporator 27 is capable of being taken into and out of the evaporator compartment 9. The evaporator 27 is enclosed in a casing 27*a*. The bottom and an upper portion of one side of the casing 27*a* facing the cold storage compartment 2 are open, and those openings serve as an air inlet 29 and an air outlet 30, respectively, as shown in FIG. 4. A compartment fan 31 is provided in the air outlet 30.

Returning to FIG. 3, a pipe 33 connects between an outlet of the compressor 20 and an inlet of the condenser 23. A pipe 34 connects between an outlet of the condenser 23 and an inlet of the evaporator 27. Furthermore, a pipe 35 connects between an outlet of the evaporator 27 and an inlet of the compressor 20. As a result, a refrigerating cycle is constituted as well known in the art. The pipes 34 and 35, both connected to the evaporator 27, are bundled en route and covered with a tube made of a heat insulating material. The pipes 34 and 35 together can be drawn out sideways from the left-hand edge of the heat insulating cover 25. Portions of the pipes 34 and 35, drawn out of the heat insulating cover 25, are fixed by a semicircular pressing member 37. A recess 38 is formed in a side edge of the front of the evaporator compartment 9. The pressing member 37 is fitted into the recess 38.

A heat insulating packing 39 is attached to the peripheral edge of the front opening 10 of the front wall of the evaporator compartment 9 including the recess 38. A pair of stud bolts 41 protrude from the upper and lower edges of the front wall of the evaporator compartment 9, respectively. The heat insulating cover 25 is formed with bolt insertion holes 42 for the respective stud bolts 41. An electrical parts box 43 is mounted on the front side of the heat insulating cover 25.

The support panel 15 is pushed onto the base plate 13 as described above and the evaporator 27 is accommodated through the front opening 10 into the evaporator compartment 9. The stud bolts 41 are inserted into the respective insertion holes 42 in the midst of the pushing. When each stud bolt 41 is inserted into the hole 42 it assumes a predetermined location, and the heat insulating packing 39 of the cover 25 abuts the front wall of the evaporator compartment 9 with the pressing member 37 being fitted into the recess 37. Furthermore, nuts 80 are engaged with the protruding ends of the stud bolts 41 having passed through the heat insulating cover 25. Consequently, the cover 25 airtightly closes the front opening 10 of the evaporator compartment 9. The support panel 15 is fixed to the base plate 13 in the manner as described above. Thus, the evaporator 27 is accommodated in the evaporator compartment 9 and the condenser unit 24 is accommodated in the equipment accommodating space 11.

A cold air guide plate 45 is provided in the interior of the cold storage compartment 2 so as to be located between the evaporator compartment 9 and the cold storage compartment 2. The guide plate 45 extends from below the fan 31 obliquely upward toward a location slightly below the ceiling of the cold storage compartment 2. A return plate 46 extends downward from the underside of the guide plate 45. A lower end of the return plate 46 is located slightly above the bottom of the cold storage compartment 2. A predetermined space is defined between the return plate 46 and the side wall 1*a* of the storage heat insulating box 1 partitioning the cold storage compartment 2 and the equipment accommodating space 11. The space serves as a return path 47 communicating with an intake 29 of the evaporator 27.

Upon drive of the refrigeration unit 6, air in the cold storage compartment 2 is circulated through the return path 47 as shown by arrows in FIG. 4, and is drawn into the intake 29 formed in the underside of the evaporator 27. The drawn air is converted by the evaporator 27 to cold air which is blown out toward the ceiling of the cold storage compartment 2 through the upper side of the guide plate 45 by the compartment fan 31. The cold air is thus circulated through the cold storage compartment 2.

The refrigeration unit 6 is covered with panels so that the equipment compartment is constituted. A top plate 55 extends over the storage heat insulating box 1 and the equipment compartment 12. Referring to FIG. 5, a rectangular first reinforcing member 57 is mounted to a rear stepped portion of the ceiling of the evaporator heat insulating box 8. A slender second reinforcing member 58 is mounted to the left-hand side of the first reinforcing member 57 and the upper end of the left-hand side of the evaporator heat insulating box 8. A top plate fitting 59 is screwed to the front ceiling of the evaporator heat insulating box 8 so that parts thereof are laid on an upper plate 61 of the storage heat insulating box 1 and the second reinforcing member 58.

A side panel 63 is mounted so as to cover both the evaporator heat insulating box 8 and the equipment accommodating space 11. An upper end of the side panel 63 is inwardly bent so as to be stepped into a mounting portion 63*a* to the second reinforcing member 58. The side panel 63 is caused to abut the second reinforcing member 58 and the support frames 14 and then screwed at the lower end side thereof to the side of the base plate 13 and the support frames 14. Since the support frames 14 protrude leftward relative to the evaporator heat insulating box 8 as described above, an air circulation space 64 (see FIG. 6) for hot exhaust air is defined between the side panel 63 and the side of the evaporator heat insulating box 8. The air circulation space 64 communicates with the equipment accommodating space 11 located below it.

Figure 1:
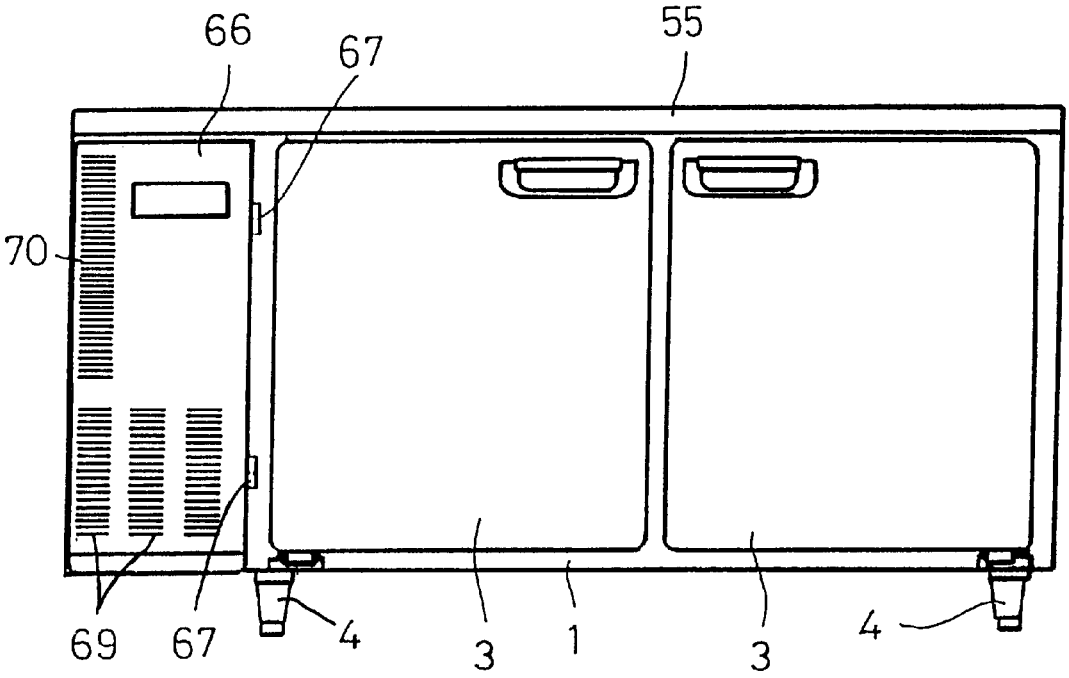
FIG. 1 is a front view of one embodiment of a refrigerator in accordance with the present invention.

An inner part of the air circulation space 64 is covered with a panel (not shown) formed by perpendicularly bending an inner edge of the side panel 63. A back panel 65 is mounted so as to form a rear wall of the equipment accommodating space 11. The equipment compartment 12 having a front opening is thus formed. Two hinges 67 are fixed to the front left-hand end 1*a* of the storage heat insulating box 1 as shown in FIG. 1. A door or front panel 66 is mounted on the hinges 67 so as to be opened and closed. The door 66 has in its lower portion a plurality of outside air inlets 69 and in its upper portion a vertically long exhaust hole 70 formed to correspond to the air circulation space 64. Furthermore, the back panel 65 and the side panel 68 are also formed with exhaust holes 71 as shown in FIGS. 1, 2 and 5.

The top plate 55 is fitted with the upper plate 61 of the storage heat insulating box 1, the first and second reinforcing members 57 and 58, and the plate 59. The top plate 55 is screwed at flanges 55*a* formed in the rear edge and left-hand and right-hand side edges thereof to thereby be fixed. For example, the left-hand side flange 55*a* is screwed together with the mounting portion 63*a* of the side panel 63 to the second reinforcing member 58.

The operation of the refrigerator thus constructed will now be described. When the refrigeration unit 6 accommodated in the equipment compartment 12 is driven, cold air produced in the evaporator compartment 9 is circulated through the cold storage compartment 2. The fan 21 is also driven so that outside air is drawn through the inlets 69 into the equipment accommodating space 11, whereby the condenser 23 and the compressor 20 are cooled. The refrigerator is sometimes installed such that the exhaust holes 71 in the rear and the side of the equipment compartment 12 are closed. In this case, the air circulation space 64 is defined between the evaporator heat insulating box 8 and the side panel 63 so as to communicate with the equipment accommodating space 11. Furthermore, the front panel 66 has the exhaust hole 70 formed to correspond to the air circulation space 64. Accordingly, hot air resulting from the heat exchange in cooling the condenser 23 etc. flows through the air circulation space 64 to be discharged outside through the exhaust holes 70 of the front panel 66 as shown by arrows in FIG. 6.

According to the above-described embodiment, hot air can be discharged outside reliably and smoothly even when the exhaust holes 71 of the rear and the side of the equipment compartment 12 are closed. Consequently, reduction in the cooling performance can be prevented.

In modifications, the support frames suspending the receiving plate and the brackets used to mount the support frame may previously be integrated together. Furthermore, although the invention has been applied to the refrigerator including the draw-out type refrigeration unit in the foregoing embodiment, the invention may be applied to refrigerators in which an evaporator is fixedly provided in an evaporator compartment defined at one side of a storage compartment.

The foregoing description and drawings are merely illustrative of the principles of the present invention and are not to be construed in a limiting sense. Various changes and modifications will become apparent to those of ordinary skill in the art. All such changes and modifications are seen to fall within the scope of the present invention as defined by the appended claims.

What is claimed is:

1. A refrigerator comprising:

a storage heat insulating box for accommodating articles to be stored, said storage heat insulating box having first and second sidewalls, a bottom wall and a rear wall;

a support panel extending sideways from a bottom portion of said first sidewall of said storage heat insulating box;

an evaporator heat insulating box for accommodating an evaporator, said evaporator heat insulating box being formed at said first sidewall of said storage heat insulating box, wherein an equipment accommodating space is formed between said evaporator heat insulating box and said support panel, the evaporator producing a cooling air that is supplied into said storage heat insulating box;

a pair of support frames provided at a front portion and a rear portion of a side of said evaporator heat insulating box, respectively, each of said support frames extending between said evaporator heat insulating box and said support panel to support said evaporator heat insulating box, said support frames being mounted on mounting members provided on the side of said evaporator heat insulating box so as to protrude sideways therefrom;

a condenser and a compressor supported on said support panel in the equipment accommodating space, said condenser and said compressor comprising a refrigeration unit together with the evaporator;

a back panel extending from said rear wall of said storage heat insulating box to thereby form rear walls of said evaporator heat insulating box and the equipment accommodating space, respectively;

a side panel extending from said back panel and located laterally outside of said support frames such that an air circulation space is defined between said side panel and a side of said evaporator heat insulating box;

a front panel extending from said side panel so as to provide a front of said evaporator heat insulating box and the equipment accommodating space;

a suction hole formed in a lower portion of said front panel and communicating with the equipment accommodating space;

an exhaust hole formed in an upper portion of said front panel and communicating with the air circulation space; and a fan provided in the equipment accommodating space, said fan being arranged to draw air in through said suction opening to cool said condenser and said compressor, wherein the drawn air is discharged as hot air through the air circulation space, formed at one side of said evaporator heat insulating box, and out of said exhaust opening.

2. A refrigerator as claimed in claim 1, wherein said front panel is hingedly mounted on said storage heat insulating box to permit movement of said front panel between an open position and a closed position.

3. A refrigerator as claimed in claim 2, wherein said back panel and said side panel are each provided with exhaust openings through which hot air can be discharged.

4. A refrigerator as claimed in claim 3, further comprising:

a base plate provided under said support panel for supporting said support panel, wherein said support panel is mounted so as to be slidable between a rearward position and a forward position on said base plate; and a heat insulating cover provided on said support panel, said heat insulating cover being located over said condenser and said compressor, wherein said heat insulating cover is adapted to cover a front opening of said evaporator heat insulating box when said support panel is moved on said base plate to the rearward position.

5. A refrigerator as claimed in claim 4, wherein said evaporator heat insulating box includes a plurality of stud bolts projecting from upper and lower portions of the front of said evaporator heat insulating box, wherein said heat insulating cover has a plurality of bolt insertion holes through which said stud bolts are received, respectively, when said support panel is moved on said base plate to the rearward position, wherein each of said stud bolts has a distal end that is engagable with a nut so that, upon application of the nuts to said stud bolts, said heat insulating cover is pressed against the front of said evaporator heat insulating box.

* * * * *